US008572769B2

(12) United States Patent
Gamracy et al.

(10) Patent No.: US 8,572,769 B2
(45) Date of Patent: Nov. 5, 2013

(54) TEMPERATURE CONDITIONING OF AIR ABOUT A SPA VESSEL

(75) Inventors: Jody Gamracy, Edmonton (CA); Gustaaf Maarten Rus, Devon (CA); Darcy S. Amendt, Breton (CA)

(73) Assignee: Blue Falls Manufacturing Ltd., Thorsby (CA)

( * ) Notice: Subject to any disclaimer, the term of this patent is extended or adjusted under 35 U.S.C. 154(b) by 1304 days.

(21) Appl. No.: 11/943,488

(22) Filed: Nov. 20, 2007

(65) Prior Publication Data

US 2008/0115264 A1 May 22, 2008

Related U.S. Application Data

(60) Provisional application No. 60/866,487, filed on Nov. 20, 2006, provisional application No. 60/889,144, filed on Feb. 9, 2007.

(51) Int. Cl.

| | |
|---|---|
| ***A61H 33/02*** | (2006.01) |
| ***A47K 4/00*** | (2006.01) |
| ***A47K 3/00*** | (2006.01) |
| ***A47K 3/14*** | (2006.01) |
| ***E04H 4/00*** | (2006.01) |

(52) U.S. Cl.

USPC ..... 4/545; 4/539; 4/541.1; 4/514; 4/493; 4/494; 4/505

(58) Field of Classification Search

USPC ..... 4/541.1, 514, 494, 545, 538, 496, 493, 4/505, 539

See application file for complete search history.

(56) References Cited

U.S. PATENT DOCUMENTS

| | | | |
|---|---|---|---|
| 4,761,838 | A | 8/1988 | Hargrove |
| 6,770,043 | B1 | 8/2004 | Kahn |
| 2006/0288476 | A1 | 12/2006 | Reynolds, II |
| 2007/0079436 | A1 | 4/2007 | Na et al. |

OTHER PUBLICATIONS

Atera Spas with Fireside Chat and Ramada Spa Surround; New AT-CTS3 AnyTempTM Patent Pending Controlled Temperature Systems; www.ateraspas.com/spas.htm; printed Jun. 28, 2007.

Plant Fair Nursery, Inc.; Hot Tub Features—Air Injection—http://plantfairnursery.com/features.htm; printed Jan. 2, 2007.

Good Life Spas—80/20 Radiant Heat Transfer System; http://www.goodlifespa.com/hybridheat.html; printed Jan. 2, 2007.

*Primary Examiner* — Jason J Boeckmann
*Assistant Examiner* — Steven M Cernoch
(74) *Attorney, Agent, or Firm* — Sean Goodwin; Linda Thompson

(57) ABSTRACT

A spa heats or cools air in the air space surrounding the water containment vessel to heat or cool the water in the water containment vessel. The air is heated and cooled and is circulated within the spa cabinet in contact with the underside of the tub and the plumbing for transferring or absorbing heat from the water through the tub and the plumbing. The air is heated by a solid state thermoelectric device or a conventional space heater and is cooled using a solid state thermoelectric device. Preferably a single thermoelectric device is mounted through a wall in the spa cabinet and is used for both heating and cooling the air in the air space.

8 Claims, 7 Drawing Sheets

Fig. 5A
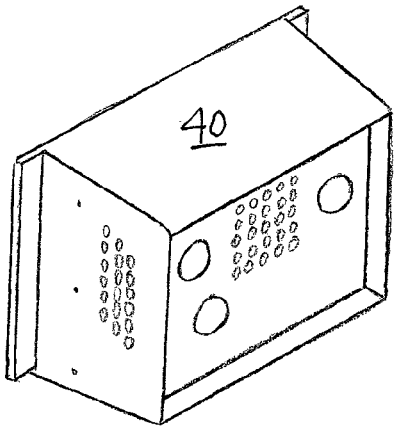
Fig. 5B
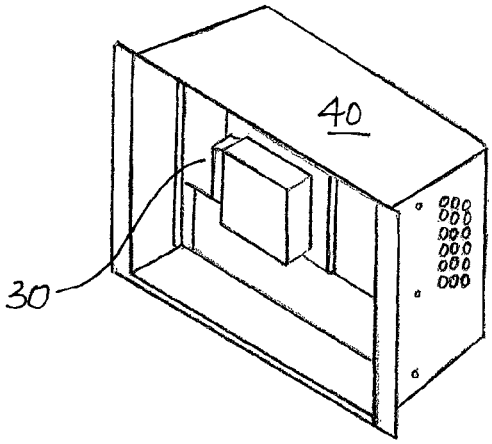
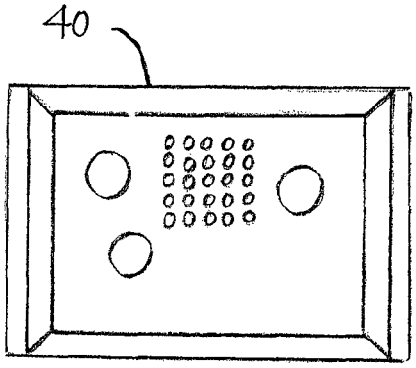
Fig. 5C
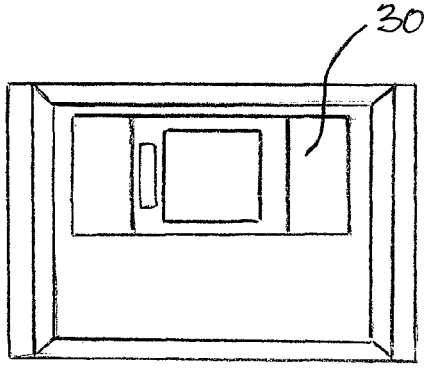
Fig. 5D

Fig. 6D
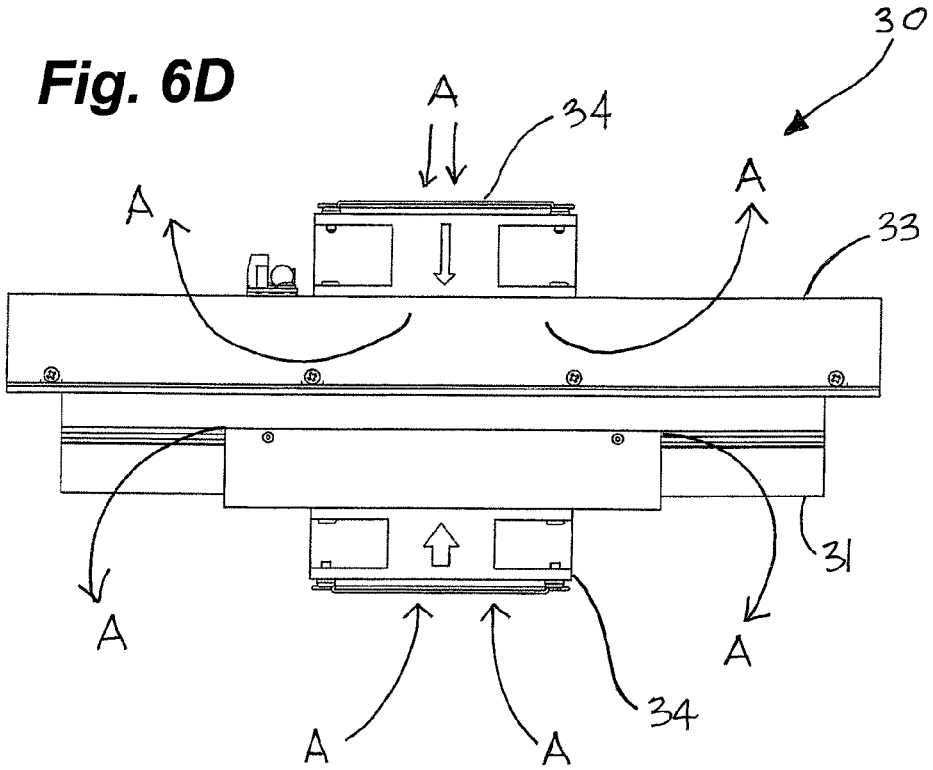
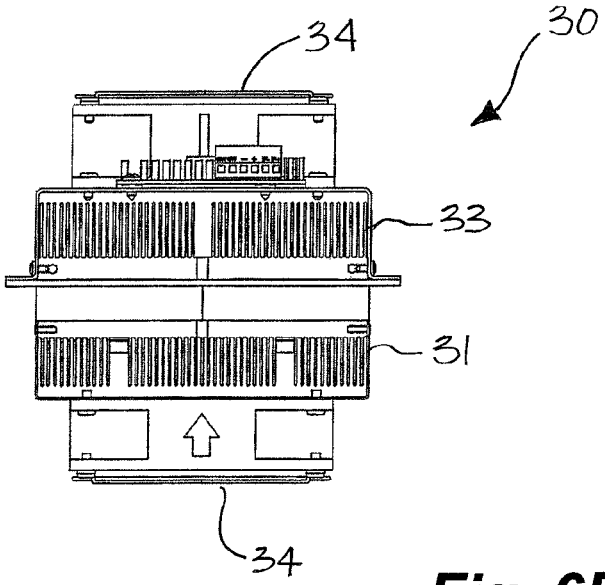
Fig. 6E

TEMPERATURE CONDITIONING OF AIR ABOUT A SPA VESSEL

CROSS REFERENCE TO RELATED APPLICATION

This application is a regular application claiming priority of U.S. Provisional Patent application Ser. No. 60/866,487 filed on Nov. 20, 2006, the entirety of which is incorporated herein by reference and U.S. Provisional Patent application Ser. No. 60/889,144, filed Feb. 9, 2007, the entirety of which is incorporated herein by reference.

FIELD OF THE INVENTION

The invention relates to spas, more particularly to spas having both heating and cooling.

BACKGROUND OF THE INVENTION

Spas, such as portable spas, typically accommodate 4 to 12 individuals and are usually stand-alone upright structures in which the water reservoir, plumbing and controls are housed within a cabinet for forming a single self-contained unit. Portable spas are popular as they can be located at virtually every home. Spas are typically installed outdoors and can be used all year round, including in winter freezing conditions and at elevated summer temperatures. Particularly for use at sub-zero conditions, the water in the spa is typically maintained at a temperature slightly above body temperature (such as about 103° F.). A removable insulated spa cover positioned to cover the temperature controlled water minimizes heat losses from the water during periods of low ambient temperature.

Conventionally, spas are less frequently used during hot weather as the user quickly overheats. Users are more likely to seek out cooler water in a swimming pool to seek relief from the heat. Owning and maintaining a swimming pool may be a costly and time consuming venture. Further, should the user wish to have both, a spa and a pool, the cost and maintenance requirements increase significantly. In some areas, ownership of a pool is prohibited by law or severely regulated regarding fencing and the like. Space restrictions as well as financial and time concerns may limit a user's ability to have a pool.

To date, spas are typically heated by flowing water through a heating device, such as being pumped through a compressor-based flow-through heat pump or by directly contacting the water with a submersed resistive heating element.

One spa that provides both heating and cooling is the Atera ANYTEMP SPA™ available from Four Seasons Home Products, Inc. of Phoenix, Ariz., USA. The Atera spa uses a 4.3 kW electric heater to heat the water and a separate 6000 BTU water chiller to cool the water.

There is interest in apparatus and methods for efficiently heating and cooling the water in the spa for use in both cold weather and hot weather conditions.

SUMMARY OF THE INVENTION

A spa is provided which has the capability of being heated for use in cold weather and of being cooled for use in warm weather. Air within an air space in the spa cabinet and which surrounds the water containment vessel is heated or cooled which results in transfer of heat to the water or from the water as required.

In a broad aspect of the invention a spa for use in cold weather and hot weather conditions comprises: a spa cabinet; a water containment vessel adapted to contain water, the water containment vessel being manufactured from a heat-conducting material, the water containment vessel being supported in the spa cabinet such that an air space is formed therebetween; heating apparatus fluidly connected to the air space for heating air in the air space for transferring heat from the heated air contained therein through the water containment vessel to the water contained therein for heating the water; and cooling apparatus fluidly connected to the air space for cooling the air in the air space for transferring heat from the heated water through the water containment vessel to the air contained in the air space for cooling the water.

In one embodiment of the invention, the heating and cooling is accomplished using a single apparatus mounted for fluid connection to the air space.

In another embodiment the heating and cooling apparatus is a single thermoelectric apparatus having an inner thermal side and an outer thermal side. When current is applied at a normal polarity the thermoelectric apparatus extracts heat at the inner side from the air space and heat is dissipated outside the spa cabinet from the outer thermal side. When the polarity is reversed, heat is dissipated from the inner thermal side to the air space and heat is extracted at the outer thermal side from the environment outside the spa cabinet.

Fans may be incorporated in the spa cabinet or in the heating and cooling apparatus to assist with heating and cooling of the air in the air space. Alternatively, air movement for heating and cooling may be as a result of fans incorporated with other apparatus in the spa cabinet, such as fans for cooling the water pump motors.

BRIEF DESCRIPTION OF THE DRAWINGS

FIG. 5A-5C illustrate the thermoelectric apparatus of FIG. 4, more particularly, FIG. 5A is a front isometric view of the apparatus of FIG. 4;

FIG. 5B is a back isometric view of the apparatus of FIG. 4;

FIG. 5C is a plan view of the apparatus of FIG. 4; and

FIG. 5D is a back view of the apparatus of FIG. 4; and

FIG. 6A-6E illustrate a commercially available thermoelectric apparatus according to an embodiment of the invention, more particularly, FIG. 6A is a perspective view of the thermoelectric apparatus;

FIG. 6B is a plan view according to FIG. 6A;

FIG. 6C is a bottom view according to FIG. 6A

FIG. 6D is a side view according to FIG. 6A; and
FIG. 6E is an end view according to FIG. 6A.

DETAILED DESCRIPTION OF THE PREFERRED EMBODIMENT

Figure 1:
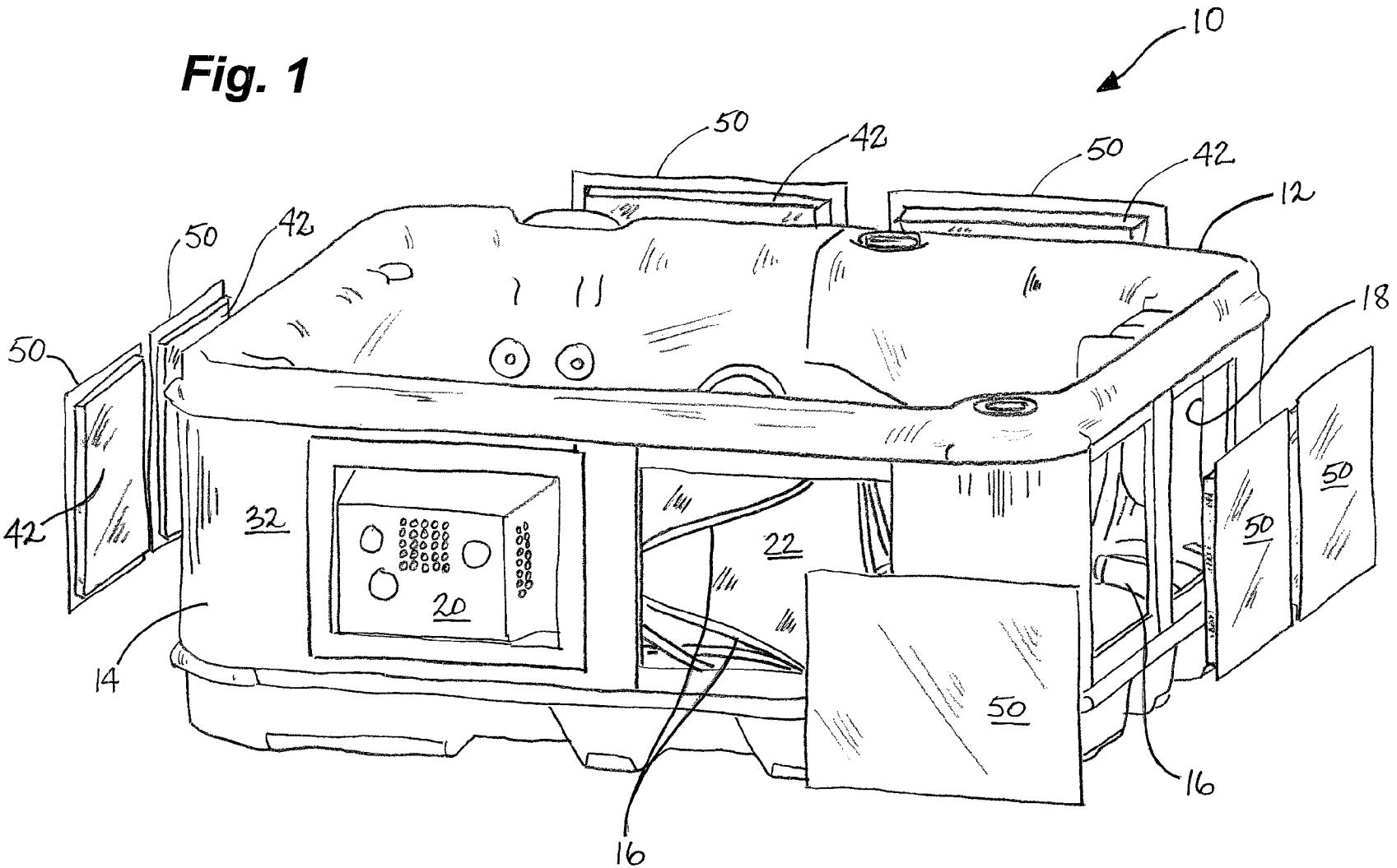
FIG. 1 is a front perspective view of a spa incorporating heating and cooling of air for heating and cooling water in a water containment vessel according to an embodiment of the invention, replaceable panels being removed for viewing an air space in a spa cabinet in which the water containment vessel is supported.
Figure 2:
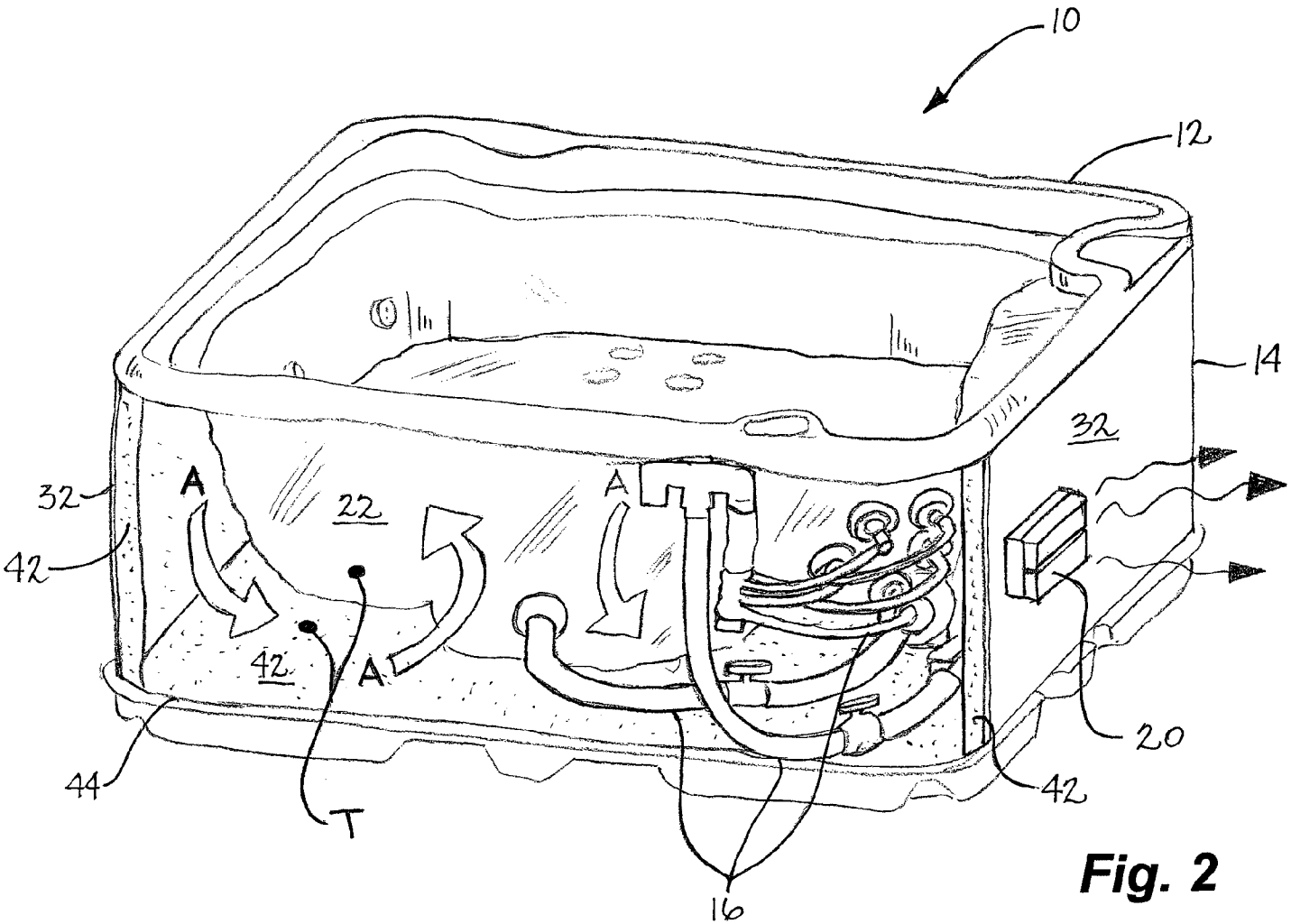
FIG. 2 is a side perspective view according to FIG. 1, a portion of the spa cabinet removed for ease of viewing of the air space and plumbing housed therein.
Figure 3:
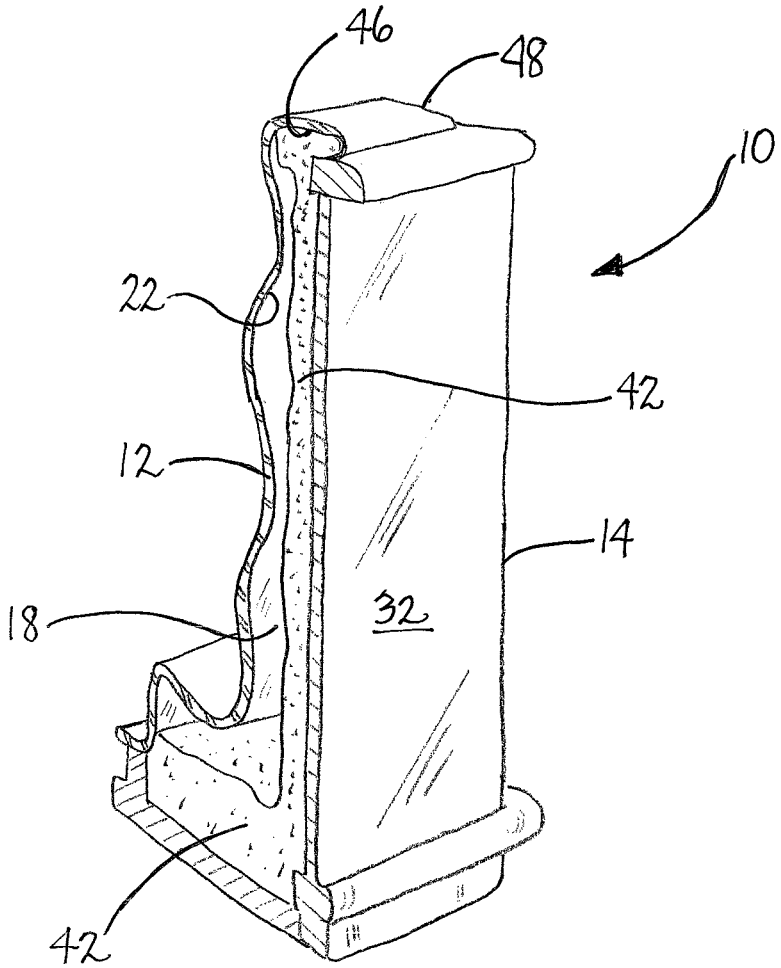
FIG. 3 is a partial sectional view of the spa of FIG. 1 illustrating insulation about a periphery of the spa cabinet, the water containment vessel and the air space formed therebetween.
Figure 4:
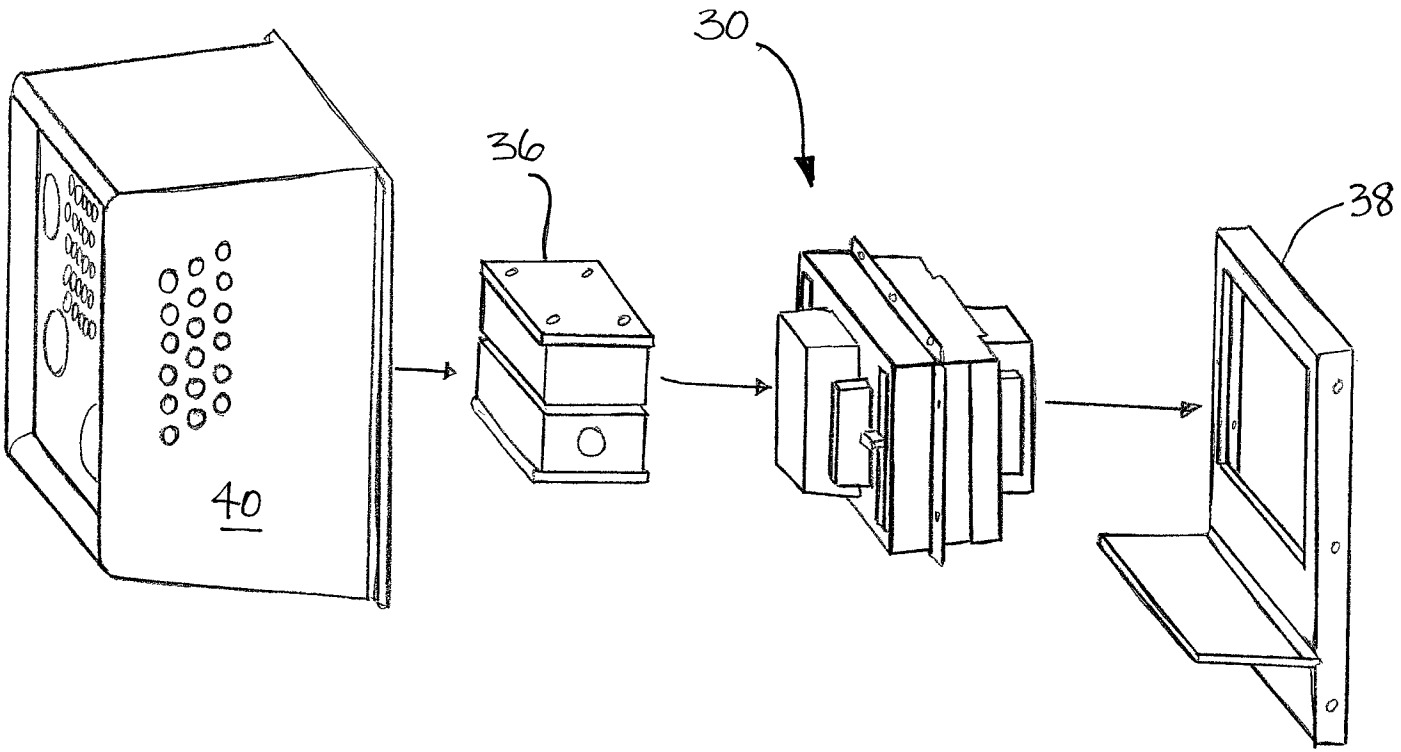
FIG. 4 is an exploded perspective view of a thermoelectric heating and cooling apparatus according to an embodiment of the invention, a mounting bracket for mounting through a wall of the spa cabinet and a ventilated shroud for covering the apparatus.
Figure 6A:
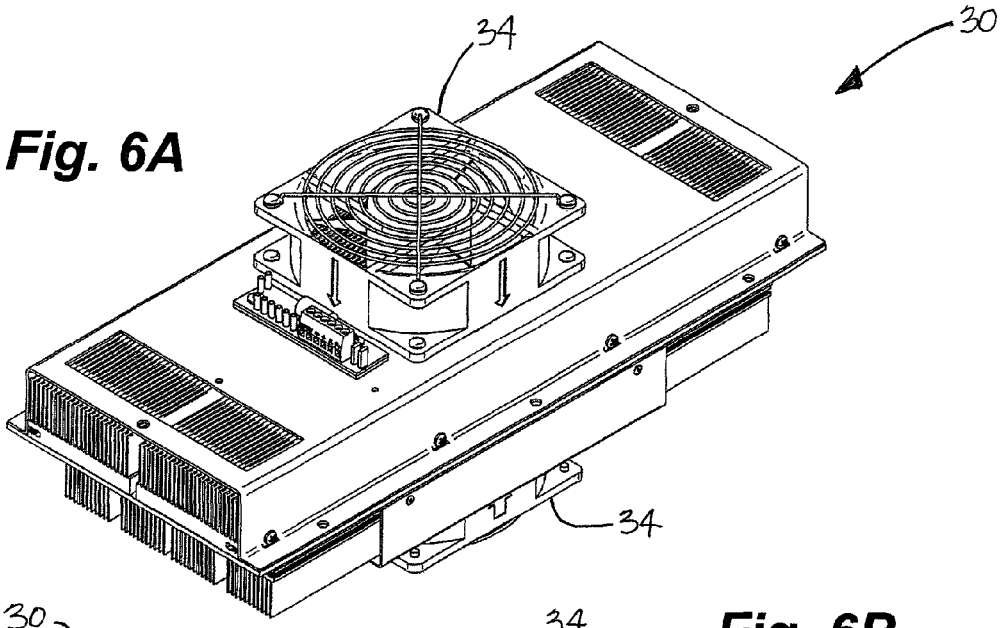
Figure 6B:
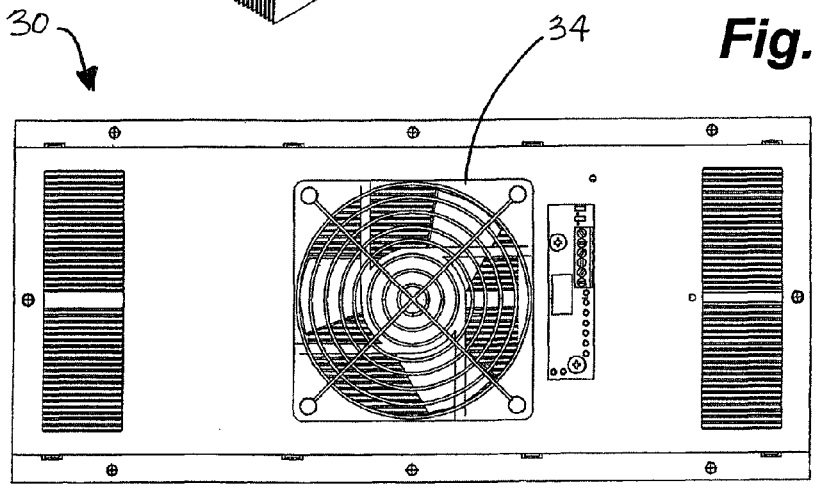
Figure 6C:
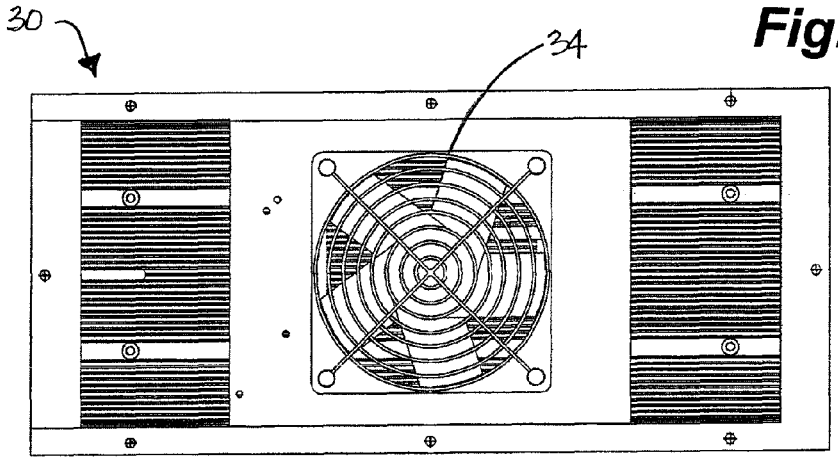

As shown in FIGS. 1-3, a spa 10 is provided which is capable of both conventional cold weather operation and hot weather operation. In embodiments of the invention heating and cooling of water are accomplished by heating the air typically surrounding at least a portion of the spa's water containment vessel without the requirement for conventional heating equipment. Sufficient water is provided in the water containment vessel to accommodate one or more users therein. Further, in embodiments of the invention, the heating and cooling are accomplished using a single apparatus.

Having reference to FIGS. 1 and 2, and in an embodiment of the invention, the spa 10 comprises a water containment vessel 12 which is supported in a spa cabinet 14. The spa cabinet 14 is generally aesthetically pleasing and shields the water containment vessel 12 and associated plumbing equipment 16 and the like from the environment. The water containment vessel 12 is formed from a material which is capable of transferring heat therethrough, such as a relatively thin acrylic or ABS plastic shell supported by a layer of fibreglass thereunder.

An air space 18 is formed between the spa cabinet 14 and the water containment vessel 12. Further, at least the plumbing 16, including pumps and piping for supply, recirculation and draining of the water, is housed within the air space 18. Heating and cooling apparatus 20 are fluidly connected to the air space 18 for heating or cooling of the air A therein. The heated or cooled air A is typically circulated throughout the air space 18 in the spa cabinet 14 in contact with at least an underside 22 of the water containment vessel 12 and an outer surface of the plumbing 16 housed in the air space 18 for transferring heat to water in the water containment vessel 12 and the plumbing 16 when the air A is heated or for absorbing heat from the water when the air A is cooled.

In embodiments of the invention, the heating and cooling apparatus 20 is either separate apparatus or a single apparatus. Suitable heating and cooling apparatus 20 include solid state thermoelectric heater/coolers, compressor-based heat pumps and the like which are capable of conditioning the air A in the air space 18 to a desired temperature for transferring heat to or absorbing heat from the water. The apparatus used for heating can also be a conventional space heater.

Having reference to FIGS. 1 and 4-6E, and in one embodiment of the invention, the heating and cooling apparatus 20 is a thermoelectric apparatus 30, such as a Peltier cell. The thermoelectric apparatus 30 is typically mounted through a sidewall 32 in the spa cabinet 14 for fluidly connecting to the air space 18. The thermoelectric apparatus 30 conditions the air A in the air space 18 in contact with at least the spa's water containment vessel 12 through convection or through forced circulation, such as by a fan.

As shown in FIGS. 1, 4 and 5A-5D, a power source 36 is operatively connected to the thermoelectric apparatus 30 which is mounted in the wall 32 of the spa cabinet 14 using a mounting bracket 38, A vented shroud 40 is mounted on an outside of the spa cabinet 14 and over the thermoelectric apparatus 30 for covering and protecting the thermoelectric apparatus 30.

In one embodiment, the thermoelectric apparatus 30 is a solid-state electronic device that uses direct current and unique properties of two dissimilar metals to create a heating/cooling pump. As shown in FIG. 6A-6E, one such thermoelectric apparatus 30 is an air-to-air assembly, Supercool Model AA-200-24-22-00-00, available from Supercool AB, a unit of Laird Technologies, Goteborg, Sweden, which provides a maximum of 195 W of energy and has an operating temperature in a range of from about −10° C. to about 46° C. The technology is commonly used for cooling, such as to cool computer CPU's, small storage containers, and many other commercial applications that require precise, reliable, cooling. Such apparatus are commonly known as Peltier cells, thermoelectric coolers, or TEC's. While referred to as a cooler, this is a descriptive term only as TEC's are alternately able to heat.

Low power TEC's are well suited to adjust and maintain temperatures and to lower water temperature, however additional heating apparatus may be required for initial heating of the water to desired operational temperature.

The TEC 30 typically comprises an inner thermal side 31 and an outer thermal side 33, each of the inner and outer thermal sides 31,33 being capable of either providing heat or dissipating heat dependent upon a polarity of the current applied thereto. Cooling is accomplished when a DC voltage power source 36 with a normal polarity is applied to a closed circuit comprising the dissimilar metals and a temperature change occurs at the junction of the dissimilar metals. There is a decrease in temperature at the cold junction, being the inner side 31 resulting in absorption of heat from the air space. Waste heat is dissipated from the outer side 33, generally to the environment outside the spa cabinet 14.

In the case where the TEC is used to heat, the polarity of the power source 36 is reversed and the heat is dissipated from the inner side 31 toward the air space 18 for heating the air A therein. Heat is extracted at the outer side 33 from the environment outside the spa cabinet 14.

Peltier cells have no moving parts, are light weight and may be used in any orientation. One or more fans 34 may be incorporated in the TEC to circulate the heated or cooled air A more efficiently from the TEC 30 to the air A in the air space 18 and therethrough.

Alternatively, one or more fans (not shown) may be incorporated in the spa cabinet 14 for directing air A from the air space 18 toward the TEC 30 for heat transfer therebetween. In some cases, fans used to cool the water circulation pumps housed within the spa cabinet 14 may act to circulate the air A therein.

Operationally, in the case of a single thermoelectric apparatus 30, a control is provided to switch between a heating function and a cooling function.

In an embodiment of the invention wherein two separate apparatus are used for the heating and cooling, one of either the heating apparatus or the cooling apparatus is activated depending upon the function desired. The heating and cooling apparatus 20 can both be the same type of apparatus or can be a combination of different types of apparatus as noted above. For example only, a conventional space heater can be used to heat the air A in the air space 18 and one of either a TEC 30 or a compressor-based heat pump can be used for cooling the air A in the air space 18 or both of the apparatus can be TEC's 30,30 or compressor-based heat pumps or the like.

Having reference to FIGS. 2 and 3 and in embodiments of the invention, for minimizing heat losses, the conditioned air A in the air space 18 surrounding the water containment vessel 12 is insulated from the external ambient air. Insulation 42 is applied about a periphery of the spa cabinet 14 leaving the air space 18 substantially devoid of any insulation and obstruction for allowing the conditioned air A to be substantially maximally exposed to the water containment vessel 12 and the plumbing 16. The spa cabinet 14 is insulated such as with high density urethane foam applied to a floor 44 and the cabinet walls 32 and further the insulation 42 may be applied to an underside 46 of a rim 48 of the water containment vessel 12 for insulating the air space 18. Similarly the plumbing 16 housed within the air space 18 is also devoid of any insulating covering thereabout to ensure substantially maximum heat transfer therethrough.

Advantageously during cold weather operation, the insulated, protected air space 18 enables efficient performance of the plumbing 16 and electrical equipment and incidental heat from pump motors may be directed inward to the air space 18 thereby decreasing heating costs by capturing and transferring the incidental heat to the water. Motor heat is an extra heat load during warm weather use which can be cooled by the heating and cooling apparatus 20.

Having reference to FIG. 2, a temperature sensor T can be provided in the air space 18, or alternatively on the water containment vessel 12 to sense temperatures related to water temperature. The sensor T is operatively connected to the heating and cooling apparatus 20 for assisting with controlling the temperature of the air A in the air space 18 and ultimately for controlling the temperature of the water in the water containment vessel 12.

Embodiments of the invention lend themselves readily to retrofitting existing conventional spas provided the water containment vessel 12 is appropriately constructed of material which conducts heat. If necessary any superfluous insulation 42 can be removed from the air space 18 and the spa cabinet 14 insulated at the periphery if not already done so. Typically conventional spas are provided with electricity to operate conventional immersion heaters and the like and therefore electricity is readily available to operate the thermoelectric apparatus 30 or other heating/cooling apparatus 20.

In an embodiment of the invention best seen in FIG. 1, removable access covers 50 provide access to the air space 18 for servicing of the plumbing 16 and the like. The removable access covers 50 are insulated 42 and seal sufficient tightly to ensure there is no significant air loss from the spa cabinet during use.

The invention claimed is:

1. A spa for use in cold weather and hot weather conditions comprising:

a spa cabinet;

a water containment vessel adapted to contain water, the water containment vessel being manufactured from a heat-conducting material, the water containment vessel being supported in the spa cabinet such that an air space is formed therebetween; and a thermoelectric apparatus connected to the air space around the water containment vessel wherein the thermoelectric apparatus further comprises inner and outer thermal sides capable of heat absorption and heat dissipation, wherein when a current is applied to the thermoelectric apparatus with a normal polarity, the inner thermal side extracts heat for cooling the air in the air space and the outer side dissipates the heat outside the spa cabinet, wherein the heat is extracted from at least the heat-conducting material of the water containment vessel and the water contained therein for cooling the water to the desired temperature; and wherein when the current is applied to the apparatus with the reverse polarity, the outer side extracts heat from the environment outside the spa cabinet and the inner side dissipates heat for heating air in the air space for transferring the heat from the heated air to at least the heat-conducting material of the water containment vessel for conducting heat therefrom to the water contained therein for heating the water to a desired temperature.

2. The spa of claim 1 further comprising:

insulation applied about a periphery of the spa cabinet.

3. The spa of claim 1 further comprising:

plumbing in the air space for supplying and recirculating the water, wherein the plumbing is manufactured from a heat-conducting material and is devoid of insulating coverings; and wherein heat is transferred from the heated air in the air space to the heat-conducting material of the plumbing for conducting heat to the water circulating therethrough or wherein heat is extracted from the heat-conducting material of the plumbing and the water contained therein, for cooling the water circulating therethrough.

4. The spa of claim 1 wherein the thermoelectric apparatus is mounted in a wall of the spa cabinet for fluidly connecting to the air space.

5. The spa of claim 1 further comprising:

a temperature sensor operatively connected to the thermoelectric apparatus and for controlling the heating and cooling of the air in the air space.

6. The spa of claim 1 further comprising:

one or more fans fluidly connected to the air space for circulating the heated or cooled air therein.

7. The spa of claim 1 wherein the thermoelectric apparatus further comprises:

one or more fans for circulating the air for heat transfer at the thermoelectric apparatus.

8. The spa of claim 1 further comprising additional heating apparatus for initially heating of the water to the desired temperature.

* * * * *